US012037163B2

(12) United States Patent
Nielsen

(10) Patent No.: US 12,037,163 B2
(45) Date of Patent: Jul. 16, 2024

(54) INJECTION MOULDED PACKAGING WITH A CONTAINER HAVING A FOLDED UPPER RIM

(71) Applicant: Berry Superfos Randers A/S, Taastrup (DK)

(72) Inventor: Benny E. Nielsen, Kalundborg (DK)

(73) Assignee: Berry Superfos Randers A/S, Taastrup (DK)

( * ) Notice: Subject to any disclaimer, the term of this patent is extended or adjusted under 35 U.S.C. 154(b) by 0 days.

(21) Appl. No.: 17/047,928

(22) PCT Filed: Apr. 16, 2019

(86) PCT No.: PCT/EP2019/059868
§ 371 (c)(1),
(2) Date: Oct. 15, 2020

(87) PCT Pub. No.: WO2019/201967
PCT Pub. Date: Oct. 24, 2019

(65) Prior Publication Data

US 2021/0155383 A1 May 27, 2021

(30) Foreign Application Priority Data

Apr. 16, 2018 (DK) ..... PA201870224

(51) Int. Cl.
*B65D 43/02* (2006.01)
*B65D 1/26* (2006.01)
(Continued)

(52) U.S. Cl.
CPC ..... *B65D 43/0208* (2013.01); *B65D 1/26* (2013.01); *B65D 1/40* (2013.01); *B65D 25/32* (2013.01);
(Continued)

(58) Field of Classification Search
CPC ..... B65D 43/0208; B65D 1/46; B65D 1/40
See application file for complete search history.

(56) References Cited

U.S. PATENT DOCUMENTS 3,817,420 A * 6/1974 Heisler ..... B65D 43/0208 220/276
4,307,817 A * 12/1981 Cotroneo ..... B65D 43/021 215/DIG. 1
(Continued)

FOREIGN PATENT DOCUMENTS

CA 1150194 A 7/1983
DK 173774 B1 10/2001
(Continued)

OTHER PUBLICATIONS

Search Report in DK Application No. PA201870224 dated Sep. 19, 2018 (4 pages).
(Continued)

*Primary Examiner* — Jeffrey R Allen
(74) *Attorney, Agent, or Firm* — Barnes & Thornburg LLP

(57) ABSTRACT

An injection moulded packaging comprising a container and a lid, the peripheral rim portion of the lid being arranged to engage with the rim portion of the container to seal the container. The rim portion of the container has a first annular locking element arranged on the outside surface and a second annular locking element arranged on the inside surface. The peripheral rim portion of the lid having a first surface being arranged with a first annular locking element which engages with the first locking element of the container rim and a second surface being arranged with a second annular locking element which engages with the second locking element of the container rim.

14 Claims, 4 Drawing Sheets

(51) Int. Cl.
*B65D 1/40* (2006.01)
*B65D 25/32* (2006.01)

(52) U.S. Cl.
CPC ..... *B65D 2543/00092* (2013.01); *B65D 2543/00296* (2013.01); *B65D 2543/00509* (2013.01); *B65D 2543/00537* (2013.01); *B65D 2543/00555* (2013.01); *B65D 2543/00629* (2013.01); *B65D 2543/00685* (2013.01); *B65D 2543/0074* (2013.01); *B65D 2543/00796* (2013.01); *B65D 2543/00842* (2013.01)

(56) References Cited

U.S. PATENT DOCUMENTS

| | | | | | |
|---|---|---|---|---|---|
| 4,572,399 | A | | 2/1986 | Bock | |
| 4,721,210 | A | * | 1/1988 | Lawrence | B65D 43/0256 220/784 |
| 4,896,415 | A | | 1/1990 | Bock | |
| 5,511,680 | A | * | 4/1996 | Kinne | B65D 17/4011 220/791 |
| 6,845,877 | B2 | | 1/2005 | Diesterbeck | |
| 7,225,945 | B2 | | 6/2007 | Crider et al. | |
| 2008/0283527 | A1 | * | 11/2008 | Allen | B65D 43/0212 220/253 |

FOREIGN PATENT DOCUMENTS

| | | | | | |
|---|---|---|---|---|---|
| EP | 133362 | A | * | 2/1985 | B65D 1/22 |
| EP | 0133362 | A2 | | 2/1985 | |
| EP | 0207764 | A2 | | 1/1987 | |
| EP | 0234769 | A2 | | 9/1987 | |
| EP | 1179483 | A1 | | 2/2002 | |
| EP | 2523866 | B1 | | 11/2012 | |
| GB | 613278 | A | | 11/1948 | |
| JP | 2001301740 | A | | 10/2001 | |
| WO | WO 85/01030 | A1 | | 3/1985 | |
| WO | WO 99/67147 | A1 | | 12/1999 | |
| WO | WO 2015/052348 | A1 | | 4/2015 | |

OTHER PUBLICATIONS

International Search Report in International Application No. PCT/EP2019/059868, dated Jul. 23, 2019 (3 pages).

* cited by examiner

INJECTION MOULDED PACKAGING WITH A CONTAINER HAVING A FOLDED UPPER RIM

The current invention relates to an injection moulded packaging comprising a container and a lid, said container having a bottom portion, a sidewall portion extending from the bottom portion and ending in a rim portion having an upper edge, said lid having a central portion and a peripheral rim portion, said peripheral rim portion of the lid being arranged to engage with the rim portion of the container to seal the container, said rim portion of the container having a first annular locking element arranged on the outside surface of the container rim and a second annular locking element arranged on the inside surface of the container rim, said peripheral rim portion of the lid comprising a downward facing U shaped groove into which the rim portion of the container can be engaged, said downward facing U shaped groove having a first surface facing the central portion of the lid and a second surface facing away from the central portion of the lid, said first surface being arranged with a first annular locking element which engages with the first locking element of the container rim and said second surface being arranged with a second annular locking element which engages with the second locking element of the container rim when the lid is mounted on the container.

DESCRIPTION OF RELATED ART

Containers of various shapes and sizes and with various functionalities are well known in the art. Containers can also be made via many different manufacturing methods, however, one popular method is to use injection moulding. When injection moulding a container, many different functionalities can be integrated into the container due to the precise shapes that can be made via an injection moulding operation. For example, many different types of rims and lids can be provided to provide many different types of sealing properties. However, care needs to be taken when designing an injection moulded container since the container needs to be taken out of the mould in an efficient manner after the moulding procedure is finished.

Depending on the design of the container to be injection moulded, the injection mould can be simple or more complex. In most cases, it is desired to have an injection mould which only comprises two mould halves and which are drawn apart from each other to release the container. However, in certain cases, additional cores need to be designed which need to be withdrawn in multiple steps to free the injection moulded part from the mould. This issue is well known to the person skilled in the art of injection moulding. Designing parts to be easy to take out of an injection mould can therefore be a complicated task.

At the same time, when designing injection moulded containers for certain applications it is desired to provide a good sealing ability between a lid and the container. Furthermore, it can be desired to ensure that the lid remains safely on the container in the case that a container is dropped. For example, a situation could be imagined where a container filled with paint is dropped by accident. In this case, it is desired that the lid remains firmly seated on the container without popping off and releasing the paint onto the floor or other surface.

Good sealing abilities are often provided by secure locking means in the form of annular rings/grooves on the inside or outside surface of the upper rim portion of the container which engage with corresponding rings or grooves on a rim portion of the lid. However, often times, these locking/sealing means can interfere with removing the container easily from the mould.

Some examples of containers and lids are provided in U.S. Pat. Nos. 6,845,877, 5,511,680, DK1773774, U.S. Pat. Nos. 4,572,399, 4,307,817 A and GB613278 A. However, the above mentioned prior art containers are in many cases difficult to remove from an injection mould, have poor sealing/locking properties and/or are not made in an injection moulding operation.

SUMMARY OF THE INVENTION

It is therefore a first aspect of the current invention to provide an injection moulded plastic packaging comprising a container and a lid, where the container is easy to remove from the injection mould while also providing very good sealing and/or locking properties.

This is provided at least in part by the features presented in the characterizing portion of claim 1. In this way, a packaging is provided which is easy to remove from the injection mould while also providing very good sealing and locking properties.

In one embodiment, the first and/or the second annular locking elements of the container and/or the lid could be annular ring shaped ridges protruding from the surface on which they are arranged and extending around the periphery of the rim of the container and/or the lid respectively. In one embodiment, they could also be grooves which engage with ridges, or ridges which engage with grooves. In one embodiment, the ring shaped ridges have a continuous ridge, while in other embodiments, the ring shaped ridges could comprise spaced apart portions of ring shaped ridges.

In one embodiment, the first and second portions of the upper rim of the container could be in contact in the second position of the second portion. In one embodiment, the lower most portion of the second portion could abut the inside surface of the first portion. In one embodiment, the second portion could abut the first portion. In one embodiment, there could be essentially no space between the first and second portions in the second position of the second portion. In one embodiment, the first and second portions could be arranged such that there is essentially no change in the total thickness of the folded rim portion when the rim portion is deformed during use. In this way, a rim portion is provided which does not change in dimensions and which will not allow a lid to detach easily from the container, and/or will not let contents of the packaging leak out during normal deformation of the packaging.

In one embodiment, the rim portion of the container could comprise a third annular locking element and the rim portion of the lid could comprise a third annular locking element which engages with the third annular locking element of the rim portion of the lid when the lid is mounted on the container.

In one embodiment, the third annular locking element on the rim of the container could be arranged on the inner surface of the container. In one embodiment, the third annular locking element on the rim of the container could be arranged above the second annular locking element. In one embodiment, the second annular locking element on the rim of the container could be arranged below the first annular locking element on the rim of the container. In one embodiment, the second locking element on the rim of the container could be arranged below the central portion of the lid. In one embodiment, the locking elements of the lid could be arranged below the locking elements of the container when the lid is mounted on the container.

In one embodiment, the central portion of the lid could comprises a raised portion which is higher than the highest portion of the rim portion of the lid. In one embodiment, the central portion of the lid could be 1 mm higher than the highest portion of the rim portion of the lid. In one such embodiment, the raised portion of the lid and the rim portion of the lid could be arranged such that when a vertical force is applied to the raised portion of the lid, then the central portion of the lid is displaced downwardly and the second locking element of the lid is pressed outwardly against the second locking element of the rim of the container and/or against the side wall portion of the container.

In one embodiment, the lid could further comprise a lid lever which has a first position where it is extending downwardly along the side of the container and a second position where the lid lever is bent outwardly about a bending line until an outer portion of the lid lever engages with an outer portion of the rim portion of the container. In this way, it is easier to remove the lid from the container.

In another aspect of the current invention, a method of manufacturing an injection moulded packaging as discussed above is presented. The method could comprise the steps of injection moulding the container with the second portion of the rim of the container in its first position, opening the mould, folding the second portion of the rim portion of the container down until it abuts the first portion of the rim of the container, and mounting the lid on the container such that the first and second portions of the upper rim portion of the container are engaged within the downward facing U shaped groove of the lid.

This specification also discloses a second invention which could form the basis of a divisional application in the future. This second invention is related to providing an additional sealing effect for a container during a shaking operation. In many situations, a container is filled with a first material, for example paint, and then at a later time a second material, for example a tinting ink, is added to the first material and then the container is shaken to evenly distribute the second material within the first material. This is well known from, for example paint stores where a "shaker" is provided to shake the container properly after adding a tinting ink.

The extra sealing ability is provided by providing a packaging comprising a container and a lid, said container having a bottom portion, a sidewall portion and an upper rim portion, said lid comprising a central portion and a peripheral rim portion, the rim portion having a flange element extending downwards from the central portion and arranged between the central portion and the rim portion and having an outwardly facing surface which is arranged to engage with the sidewall of the container when the lid is mounted on the container, wherein, the central portion of the lid is higher than the highest point of the rim portion of the lid when the lid is mounted on the container. In this way, when a force is applied by a flat element to the upper surface of the lid, the central portion will deflect downwardly before the flat element engages with the highest portion of the rim of the lid. In this way, the flange element will be pressed outwardly against the inside surface of the container as well as the rim of the lid will be pressed down on the rim of the container.

In one embodiment, the flange element is an upwardly open U shaped wall portion arranged between the central portion and the rim portion.

In one embodiment, the central portion is 1 mm higher than the highest point on the rim of the lid.

The current specification also discloses a third invention. In this third invention, a lid for a container is provided where the lid comprises a downwards facing groove which is arranged to engage with an upwardly extending flange of a container to seal the interface between the container and the lid, said downwards facing groove comprising an inner flange which is arranged to be in contact with an inner surface of the container when placed on the container and an outer flange which is arranged to be in contact with an outer surface of the container when placed on the container, the lower edge of the inner flange being arranged lower than the lower edge of the outer flange. In this way, the lid will be self centering when placed on a container as the inner flange will automatically seek to slide into the inner portion of the container. In one embodiment, the lower edge of the inner flange is arranged as a tapered surface which tapers downwardly and inwardly. A packaging comprising a container with an upwardly extending flange and a lid as described above is also provided.

The current specification also discloses a fourth invention related to a lid with a lid lever. According to the fourth invention, a lid is provided with an outer rim portion in the form of a skirt which covers an upper portion of a container when placed on the container. A portion of the skirt is arranged as a lid lever which is bendable about a bending line from a first position where the lid lever is arranged essentially parallel with the skirt portion of the container to a second position where the lid lever is bent outwardly and arranged essentially perpendicular to the skirt portion. According to the invention, the lid lever is arranged to be bendable about a bending line, said bending line being formed as an area of reduced bending stiffness, and where the bending stiffness of the bending line is arranged with variable bending stiffness along the length of the bending line, having at least two areas of low bending stiffness separated by an area of higher bending stiffness. In one embodiment, the at least two areas of reduced stiffness are provided by a through going slot. In one embodiment, the bending line is provided with at least three areas of low bending stiffness separated by at least two areas of higher bending stiffness. In one embodiment, the length, along the bending line of the areas of reduced bending stiffness is greater than the length of the areas of increased bending stiffness.

According to this specification, the bending stiffness at a point should be understood as the bending stiffness about an axis which is arranged on a horizontal plane and arranged tangent to the bending line at the point.

In one embodiment, the lid lever comprises vertically arranged flanges on the outer surface of the lid lever, said vertically arranged flanges having free upper surfaces which come into contact with the outer surface of the rim portion of the lid in the second position of the lid lever. In one embodiment, the lid lever comprises at least two outer vertically arranged flanges and at least one middle vertically arranged flange. In one further embodiment, the height of the free upper surface of the middle flange is lower than the height of the free upper surface of the outer flange. In one embodiment, the bending line is arranged such that the central portion of the bending line along its length can stretch more than the outer portions of the bending line.

It should be clear to the person skilled in the art that these additional inventions could be combined as desired with the features of the first invention as defined in the claims.

It should be emphasized that the term "comprises/comprising/comprised of" when used in this specification is taken to specify the presence of stated features, integers, steps or components but does not preclude the presence or addition of one or more other features, integers, steps, components or groups thereof.

Figure 1:
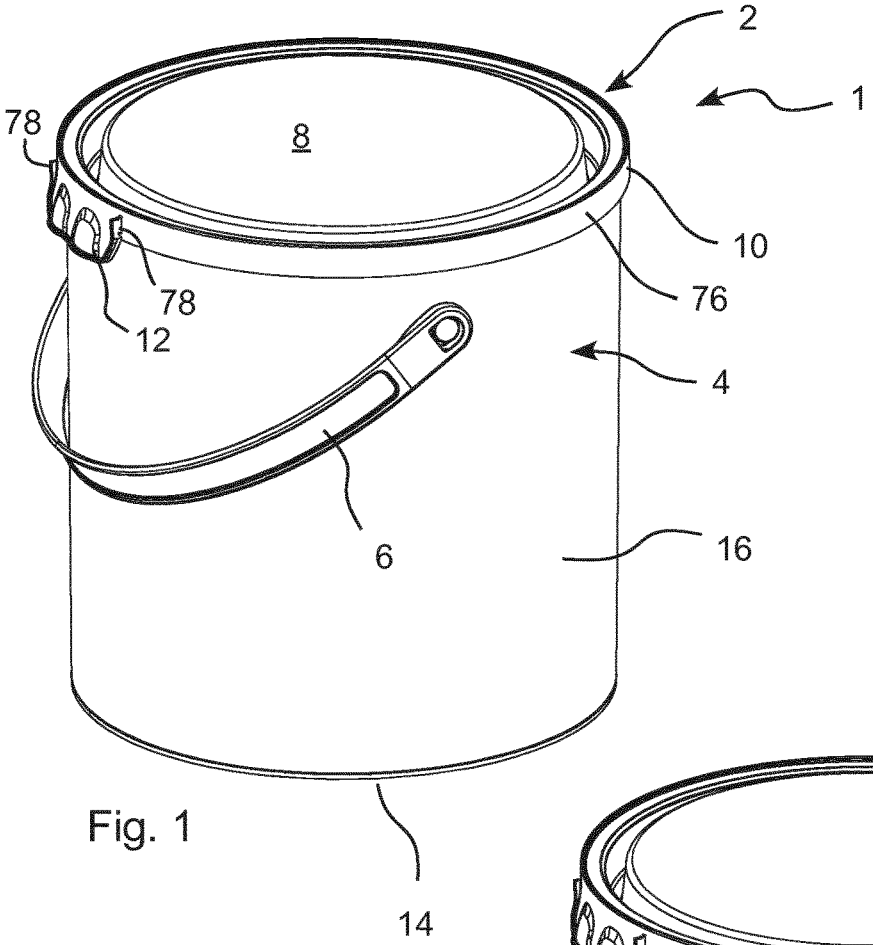
FIG. 1 shows a perspective view of a first embodiment of a packaging according to the current invention.
Figure 2:
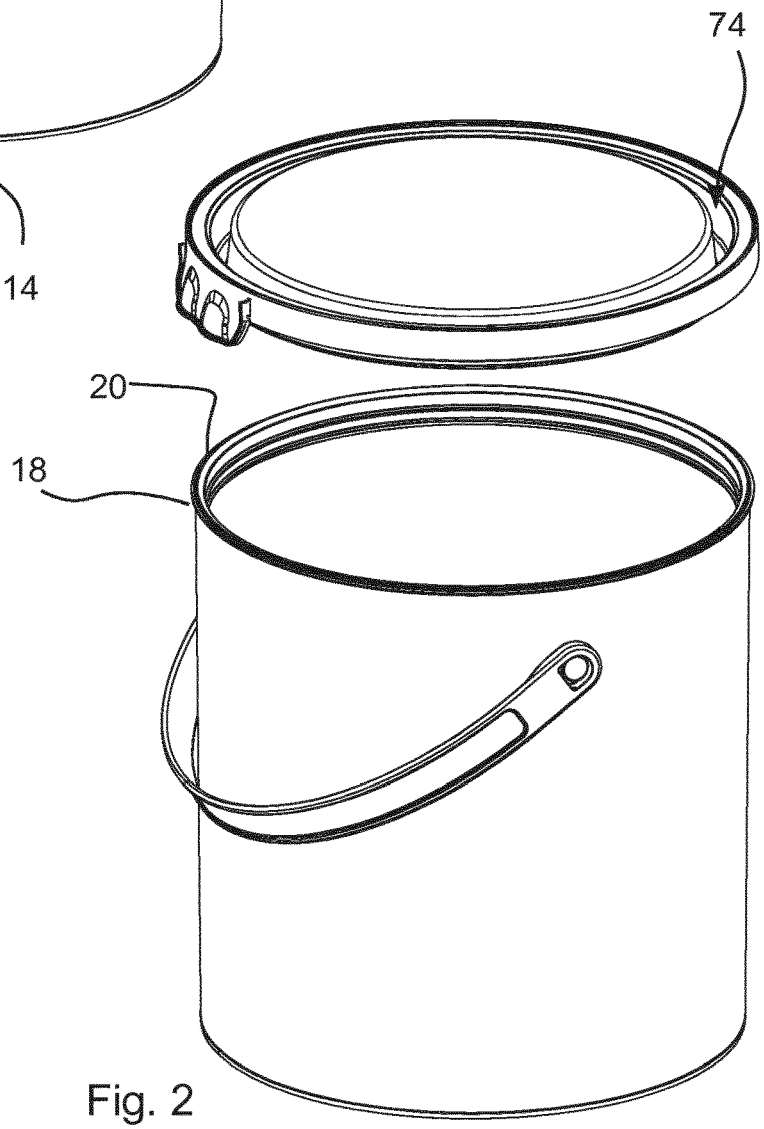
FIG. 2 shows a perspective exploded view of the packaging of FIG. 1.

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

FIGS. 1 to 6 all show different views of the same packaging 1. The packaging comprises a lid 2, a container 4 and a carrying handle 6. The lid has a central portion 8, a peripheral rim portion 10 and a lid lever 12. The specific details of the lid and the lid lever will be described together with the cross sectional views discussed below.

The container comprises a bottom portion 14, a side wall portion 16 and an upper rim portion 18 with an upper edge 20. In this embodiment, the sidewall portion of the container has a circular cylindrical shape as is known in the art. Likewise, the bottom portion has a circular shape with a circular periphery. The upper rim portion 18 also has a circular periphery in this embodiment. However, other forms of container could also be imagined.

The function of the connection between the lid and the container will be described in more detail with reference to the cross sectional views shown in FIGS. 3 to 6. It should be noted that for the sake of clarity, the cross sectional views in this application, for example FIGS. 3 to 6, only show the actual cross section, not the visible lines which would be seen behind the actual cross section.

Figure 3:
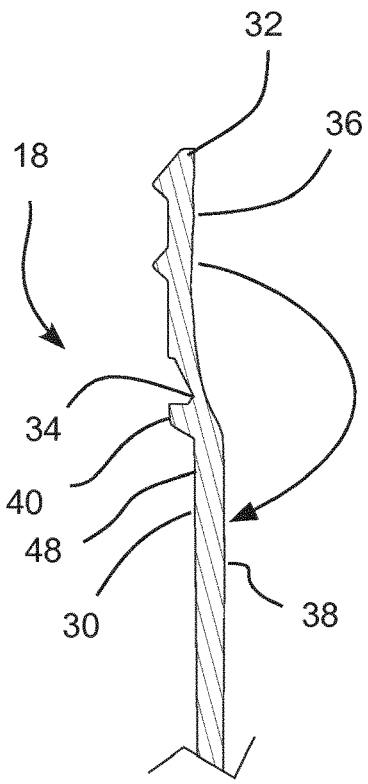
FIG. 3 shows a partial cross section through an upper portion of the container rim, just after it has left the injection mould.
Figure 4:
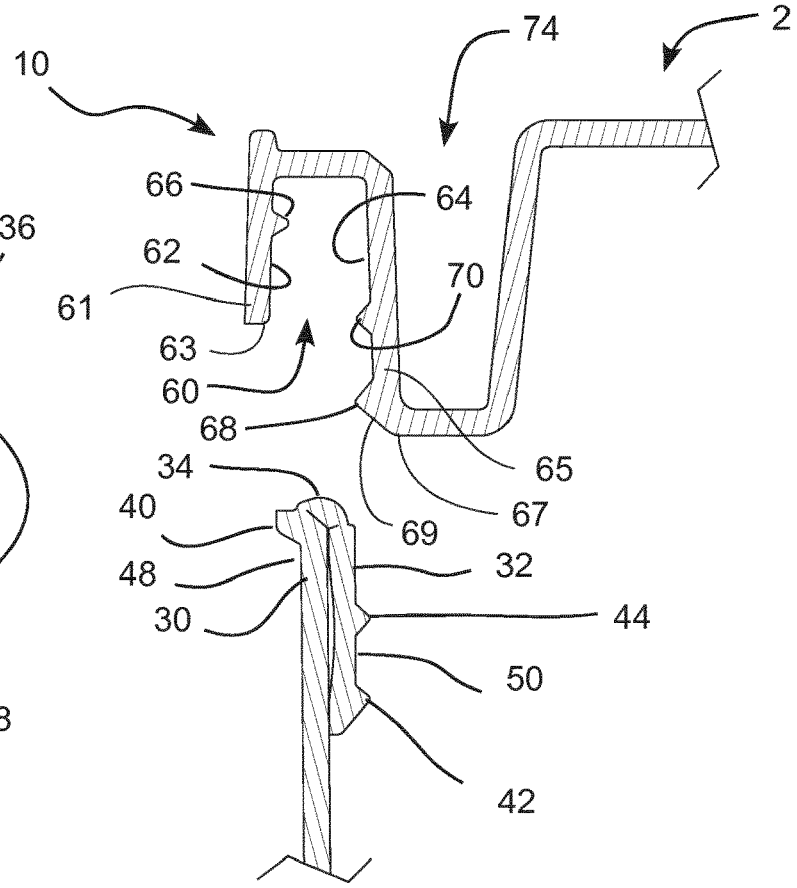
FIG. 4 shows a partial exploded cross sectional view showing both an upper portion of the container of FIG. 1 and an edge portion of the lid of FIG. 1 where the upper portion of the container rim is in a second position.
Figure 5:
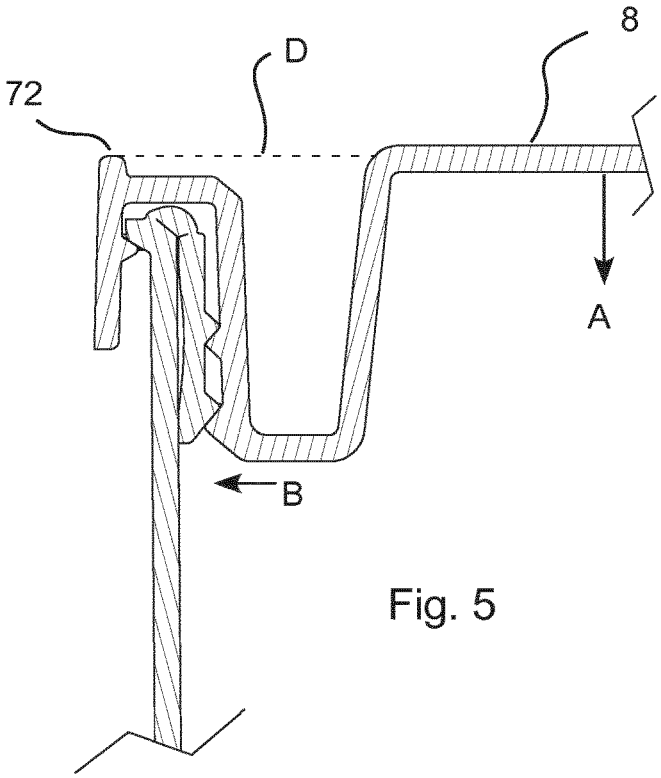
FIG. 5 shows a partial cross section through an upper portion of the rim of a container and the edge portion of a lid mounted on the container.
Figure 6:
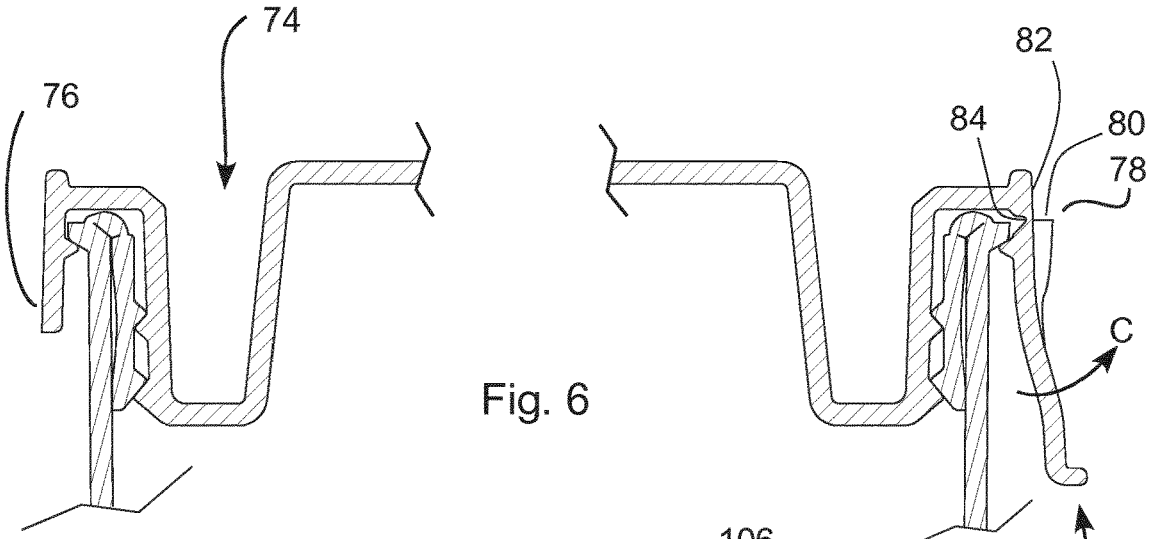
FIG. 6 shows a partial cross section view showing extra details of an embodiment of an opening lever in the form of a lid lever.

As can be seen in FIGS. 3-6, the upper rim portion 18 of the container comprises a first portion 30 and a second portion 32 separated by a bending line 34. When the container is injection moulded the second portion 32 of the rim portion is in a first position as shown in FIG. 3. In this first position, the first and second portions are essentially parallel and the second portion extends in a direction from the bending line and away from the bottom portion of the container. Once the injection moulding process is finished and the mould is opened, the second portion can be bent downwardly as shown by the big arrow in FIG. 3, such that one surface 36 of the second portion comes to abut the inside facing surface 38 of the first portion. This folded position is shown in FIGS. 4, 5 and 6. In this second position, the second portion is still essentially parallel with the first portion, however the second portion now extends from the bending line and downwardly towards the bottom portion of the container. Hence the second portion 32 of the container rim 18 has two positions, a first position which is the position during injection moulding and a second position which is the position during normal use.

The upper portion in this embodiment comprises three annular locking elements 40, 42, 44. The orientation of the annular locking elements will initially be described with reference to the second position of the second portion of the upper rim portion of the container as shown in FIGS. 4, 5 and 6. A first annular locking element 40 is in the form of an annular ridge or ring extending around the periphery of the upper rim portion and extending outwardly from the outwards facing surface 48 of the upper rim portion. Second and third annular locking elements 42, 44 are also in the form of annular ridges or rings extending around the periphery of the upper rim portion and extending inwardly from an inside facing surface 50 (in the second position) of the second portion 32 of the upper rim portion.

As will be clear to the person skilled in the art when comparing the upper rim portion 18 of the container as shown in FIG. 3 and in FIG. 4, when the second portion is in its first position, all the annular locking elements are facing outwardly and the inside surface of the container is essentially smooth. This will make it easy to open the mould, since the mould half arranged on the inside of the container will easily withdraw since there are no elements which act against the direction of motion of the inside portion of the mould. Likewise, when the second portion is folded into its second position as shown in FIGS. 4 to 6, there are annular locking elements on both sides of the upper rim portion. When corresponding locking elements are arranged on the lid, the lid will be very securely engaged on the upper rim portion of the container. Small motions or deformations of the container and/or lid will not significantly deteriorate the sealing or locking abilities of the container. Likewise, since there are locking elements on both sides of the rim portion of the container, the rim portion of the container will not distort over time and hence, the strength of the closure will not deteriorate over time. If a situation were considered where there were only engagement on the inside of the container, then it could be imagined that over time, the container rim gets slightly larger, due to slow creep, and the closure effectiveness would decrease significantly.

The lid 2 is shown in good detail in FIG. 4. As can be seen the lid has a peripheral rim portion 10 with a downwards facing U shaped groove 60. The downwardly facing U shaped groove has two opposing and essentially vertically arranged surfaces, a first surface 62 facing the centre of the lid and a second surface 64 facing away from the centre of the lid. On the first surface there is a first annular locking element 66 in the form of an annular ring shaped ridge running along the periphery of the rim and extending in towards the central portion of the lid. This first annular locking element 66 engages with the first locking element 40 of the container when the lid is mounted on the container. Second and third locking elements 68, 70 are formed on the second surface of the U shaped groove of the lid. These second and third locking elements engage with the second and third locking elements respectively of the container when the lid is mounted on the container as can be seen in FIGS. 5 and 6.

FIG. 5 shows another feature of the packaging which is the subject of a second invention as described in this specification. This second invention could be the subject of a divisional application in the future. FIG. 5 shows the lid mounted on the container where corresponding locking elements of the lid and the container are in engagement with each other. The lid is therefore firmly secured on the container.

As can be seen from the FIG. 5, a dotted line D is shown which illustrates that the central portion 8 of the lid is slightly higher than the uppermost portion 72 of the rim portion of the lid. This has the consequence, that when a packaging of this art is fixed in a shaker assembly where the lid is pressed onto the container via a flat element forced onto the lid from above, the central portion of the lid will displace slightly downwards (see arrow A) before the flat element of the shaker unit contacts the uppermost portion of the rim of the lid. Due to this downwards displacement, the lowermost and outermost portion of the inner portion of the lid, will be pressed outwardly (see arrow B) against the inside surface of the sidewall of the container. This thereby improves the sealing ability of the container even further.

Furthermore, as can be seen from FIG. 5, the contacting surfaces of the second locking element 42 of the container and the second locking element 68 of the container are provided with sloping surfaces which form an angle which points upwardly and towards the centre axis of the container. In this way, as the second locking element 68 of the lid is pressed outwardly, it will also slide along the second locking element 42 of the container thereby even further sealing the interface between the lid and the container.

In this embodiment, the lid is furthermore formed with an upwards facing U shaped groove 74 arranged between the downwards facing U shaped groove 60 and the central portion 8 of the lid.

FIGS. 4 and 5 also show another feature of the current lid design which could be the subject of a potential divisional application in the future. In this case, the inner flange 65 forming the U shaped groove of the lid extends further down that the outer flange 61 forming the U shaped groove. In other words the lower end 63 of the outer flange 61 of the downwardly facing U shaped groove is arranged above the lower end 67 of the inner flange 65 of the downwardly facing U shaped groove. In this way, when the lid is placed on the container, the lid will self-center in the opening of the container, as the central portion of the lid is located below the outer skirt portion 61 of the lid. Most lids have the opposite construction, where the outer skirt portion of the lid is the lowest part of the lid. Furthermore, in order to increase the self-centering effect, the lower outer edge 69 of the inner flange 65 of the U shaped groove is formed with a tapered surface which tapers downwardly and inwardly.

FIG. 6 shows a cross sectional view where the lid lever 12 is described in more detail. As can be seen in FIGS. 1 and 6, the lid lever 12 extends further down than the remaining skirt portion 76 of the lid. The lid lever is also spaced away from the container rim so that there is room for a user's fingers behind the lid lever. The lid lever also comprises a flange 78 at either side of the lid lever. The flange 78 is arranged to extend out and away from the lid lever. It is also arranged with an upper free surface 80 which is arranged to come into contact with an upper portion of an outwardly facing surface 82 of the lid when the lid lever is bent out (as shown by arrow C in FIG. 6) to an essentially horizontal position. Further movement of the lid lever upwardly will be transferred directly to the rim portion of the lid to help pry the lid away from the container. In this way, even though a very strong connection is provided between the lid and the container, with the help of the lid lever, the lid can still be removed from the container in an easy manner. In order to allow the lid lever to bend outwardly more easily, a bending line 84 is provided between the lid lever and the rim portion of the lid. The bending line in this embodiment is formed as a foil hinge. The functioning of the lid lever is described in more detail in applicant's patent EP2523866 which is incorporated by reference in its entirety in this specification. It should be noted that in EP2523866, the lid lever is applied to the corner of a square container, however, the functionality is similar in many aspects.

Figure 7:
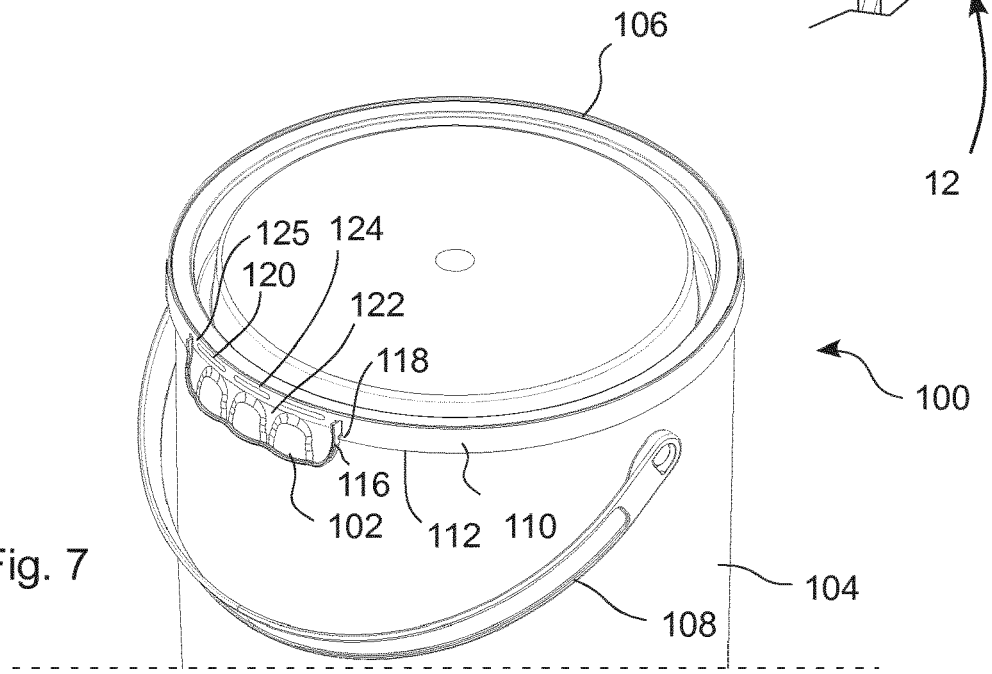
FIG. 7 shows a partial perspective view of a second embodiment of a container according to the current invention.
Figure 8:
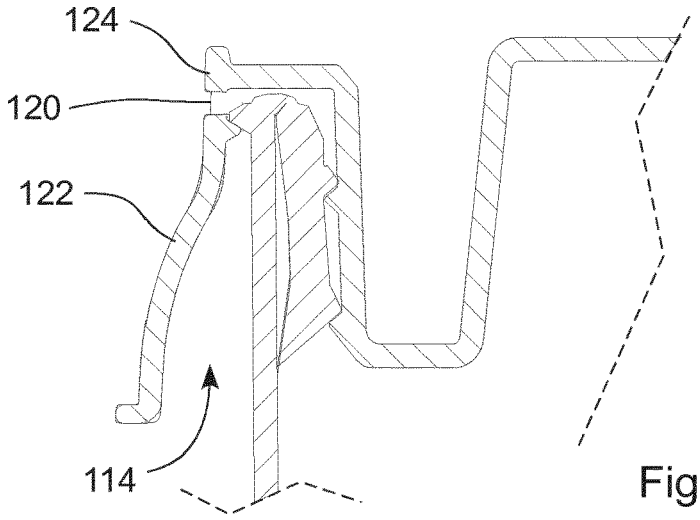
FIG. 8 shows a partial cross section view showing extra details of an embodiment of an opening lever in the form of a lid lever.

FIGS. 7 and 8 show a packaging 100 which is very similar to the packaging shown in FIGS. 1 to 6, but with a different lid lever 102. Like elements will not be described further herein, as only the lid lever will be described in detail.

The packaging 100 of FIGS. 7 and 8 has a container 104, a lid 106 and a handle 108. The lid has a lid lever 102. The basic function of the lid lever 104 is very similar to the lid lever 12 of FIGS. 1 to 6. As with the previous lid lever, the lid lever is a part of the outer skirt portion 110 of the lid. The lid lever extends lower than the lower edge 112 of the rest of the skirt portion 110. As with the previous lid lever, the lid lever is offset from the outer surface 112 of the container so that a space 114 is formed so that a user's fingers can slide in under the lid lever to allow the user to bend the lid lever outwardly. The side edges 116 of the lid lever are connected to the skirt portion of the container via breakable tabs 118 which can be used as tamper evidence. The breakable tabs are thin bridges between the lid lever and the container which break when the user bends the lid lever outwardly.

In contrast to the previous lid lever, this lid lever 102 is wider than the previous lid lever. The previous lid lever had room for two figures, while the current lid lever has room for three fingers. The width of the current lid lever is approximately 45 degrees of the outer circumference of the lid. If the lid lever is too narrow, it has been shown that the lid lever does not have an optimal effect. It can be compared to prying a bicycle tire off a rim. If a single narrow lever is used, it is not possible to get the entire tire edge to release from the rim. A number of levers are typically required spaced around a certain portion of the circumference. In one embodiment, it could be said that the lid lever needs to have a width which occupies at least 40 degrees of the circumference of the lid. In one embodiment, the lid lever needs to occupy at least 45 degrees of the circumference of the lid.

Another difference between the current lid lever and the prior art lid levers is that the current lid lever has a series of slots 120 arranged between the body of the lid lever 122 and the rim portion 124 of the lid. These slots 120 have the function of the bending line/foil hinge 84 of the previous lid lever.

However, it has been found, that when making a foil hinge as in the previous embodiment, the foil hinge needs to be made thin enough that it is easy to bend. This also has the effect that it tends to break at the sides of the lid lever, thereby reducing its effectivity. Furthermore, when bending the foil hinge, the central portion of the foil hinge and/or the outer sides of the foil hinge need to be deformed quite a bit due to the radius of the outer portion of the lid. This has had the effect, that the entire rim portion has been deformed and in the central portion has been pressed inwardly, thereby locking the rim of the lid even stronger to the rim of the container.

In the lid lever 102 of the current embodiment, the bending line is provided as a discontinuous bending line with portions having a very low bending stiffness (the slots 120) and smaller tabs portions 125 having a greater bending stiffness. This means that there is no deformation in the slot areas and a greater local deformation at the tab portions. In another embodiment (not shown) instead of slots which go through the entire depth of the lid lever, the low bending stiffness portions could be provided as a very thin web between the body of the lid lever and the rim portion of the lid which bends very easily in contrast to the local tab portions which deform less easily. In these embodiments, the slots are made via a slider in the mould which slides in from the outside of the lid. In this way, the slider can be withdrawn from the lid easily after moulding the lid. This is in contrast to the prior art lid lever, where the bending line was formed as a groove on the inside of the lid lever. This resulted in an undercut in the moulding tool which made it difficult to remove the lid from the tool.

In another embodiment (not shown), the bending line could be formed as a groove on the outside of the lid, the groove being arranged between the body portion of the lid lever and the rim portion of the lid. In this embodiment, the groove could be made having different depths along its length, such that some portions of the groove are less deep and have a greater stiffness and other portions of the groove are deeper and have a very low stiffness. In this case, the greater stiffness portions will ensure a good connection between the lid lever and the rim portion of the container, while the thinner portions will allow for maximum bending without causing the rim portion to deform and lock onto the container rim.

Figure 9:
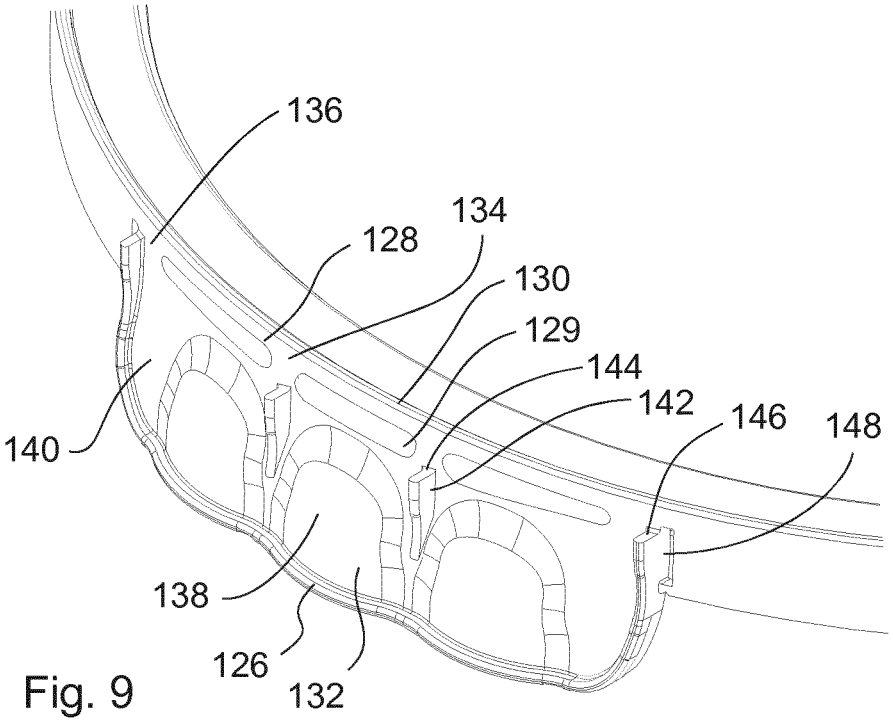
FIG. 9 shows a partial perspective view of a third embodiment of a lid lever for a container.

FIG. 9 shows another embodiment of a lid lever 126. In this case, slots 128, 129 are again used between the rim portion 130 of the lid and the body portion 132 of the lid lever separated by tab 134, 136 portions which connect the rim portion of the lid and the body portion of the lid lever. However, instead of the outer slots being arranged as linear slots having the same height along the length of the slot, in this embodiment, the lower surfaces of the outer slots are curved, and the central slot 129 has a greater height than the outer slots, such that the lower edge of the slots matches the outer radius of the rim portion of the lid. In this way, the tab portions 134 in the centre of the lid lever are longer than the tab portions 136 at the sides of the lid lever. As such, the central portion 138 of the lid lever will bend outwardly more than the outer portions 140 of the lid lever. This will allow the lid lever to bend outwardly, about the outer most tabs 136 like a stiff plate without causing the central portion of the rim portion of the lid to deform inwardly.

Furthermore, in this embodiment, additional vertically arranged flanges 142 are provided in the middle portion of the lid lever. In this embodiment, the upper contact surface 144 of the middle flanges are arranged slightly lower than the upper contact surfaces 146 of the outer flanges 148. In this way, when the lid lever bends upwardly, the middle flanges will contact at the same time as the outer flanges, due to the radius of the rim portion of the lid. It should be noted that the embodiment shown in FIG. 9 is drawn schematically, just to show the concept. The actual dimensions would have to be adjusted slightly to make the lever work in an optimal manner.

It is to be noted that the figures and the above description have shown and described the example embodiments in a simple and schematic manner. Many of the specific mechanical details have not been shown since the person skilled in the art should be familiar with these details and they would just unnecessarily complicate this description. For example, the specific materials used and the specific injection moulding procedure have not been described in detail since it is maintained that the person skilled in the art would be able to find suitable materials and suitable processes to manufacture the container according to the current invention.

The invention claimed is:

1. An injection molded packaging comprising a container and a lid, said container having a bottom portion, a sidewall portion extending from the bottom portion and ending in a rim portion having an upper edge, said lid having a central portion and a peripheral rim portion, said peripheral rim portion of the lid being arranged to engage with the rim portion of the container to seal the container, said rim portion of the container having a first annular locking element arranged on an outside surface of the rim portion of the container and a second annular locking element arranged on an inside surface of the container rim, said peripheral rim portion of the lid comprising a downward facing U shaped groove into which the rim portion of the container can be engaged, said downward facing U shaped groove having a first surface facing the central portion of the lid and a second surface facing away from the central portion of the lid, said first surface being arranged with a first annular locking element which engages with the first locking element of the rim portion of the container and said second surface being arranged with a second annular locking element which engages with the second locking element of the container rim, wherein the first annular locking element of the container is formed on a first portion of the rim portion of the container and the second annular locking element of the container is formed on a second portion of the rim portion of the container and in that said first and second portions are separated by a bending line such that the angle between the first and second portions can be changed and in that the first portion is formed as an extension of the sidewall portion of the container and having a single position and in that the second portion has two positions, a first position where the second portion is arranged essentially parallel with the first portion and extending in a direction from the bending line and away from the container bottom and a second position where the second portion is bent downwardly about the bending line so that the second portion is arranged essentially parallel with the first portion, but where the second portion extends from the bending line down towards the container bottom of the container, wherein the first and the second annular locking elements of the container and the lid are annular ring shaped ridges protruding from the surface on which they are arranged and extending around a periphery of the rim portion of the container and the lid, respectively, and wherein there is essentially no change in a total thickness of the rim portion of the container when the rim portion of the container is deformed during use, and the second portion of the rim portion of the container is configured to remain in the second position when the lid is detached from the container.

2. The packaging according to claim 1, wherein the first and second portions of the rim portion of the container are in contact in the second position of the second portion.

3. The packaging according to claim 1, wherein the rim portion of the container comprises a third annular locking element and in that the rim portion of the lid comprises a third annular locking element which engages with the third annular locking element of the rim portion of the lid when the lid is mounted on the container.

4. The packaging according to claim 3, wherein the third annular locking element on the rim portion of the container is arranged on an inner surface of the container.

5. The packaging according to claim 3, wherein the third annular locking element on the rim portion of the container is arranged above the second annular locking element.

6. The packaging according to claim 1, wherein the central portion of the lid comprises a raised portion which is higher than a highest portion of the rim portion of the lid.

7. The packaging according to claim 6, wherein the raised portion of the lid and the rim portion of the lid are arranged such that when a vertical force is applied to the raised portion of the lid, then the central portion of the lid is displaced downwardly and the second locking element of the lid is pressed outwardly against the second locking element of the rim of the container and/or against the side wall portion of the container.

8. The packaging according to claim 1, wherein the lid further comprises a lid lever which has a first position where it is extending downwardly along the side of the container and a second position where the lid lever is bent outwardly about a bending line until an outer portion of the lid lever engages with an outer portion of the rim portion of the container.

9. A method of manufacturing the packaging according to claim 1, wherein the method comprises the steps of injection molding the container with the second portion of the rim portion of the container in its first position, opening the mold, folding the second portion of the rim portion of the container down until it abuts the first portion of the rim portion of the container, and mounting the lid on the container such that the first and second portions of the rim portion of the container are engaged within the downward facing U shaped groove of the lid.

10. An injection molded packaging comprising a container and a lid, said container having a bottom portion, a sidewall portion extending from the bottom portion and ending in a rim portion having an upper edge, said lid having a central portion and a peripheral rim portion, said peripheral rim portion of the lid being arranged to engage with the rim portion of the container to seal the container, said rim portion of the container having a first annular locking element arranged on an outside surface of the rim portion of the container and a second annular locking element arranged on an inside surface of the container rim, said peripheral rim portion of the lid comprising a downward facing U shaped groove into which the rim portion of the container can be engaged, said downward facing U shaped groove having a first surface facing the central portion of the lid and a second surface facing away from the central portion of the lid, said first surface being arranged with a first annular locking element which engages with the first locking element of the rim portion of the container and said second surface being arranged with a second annular locking element which engages with the second locking element of the container rim, wherein the first annular locking element of the container is formed on a first portion of the rim portion of the container and the second annular locking element of the container is formed on a second portion of the rim portion of the container and in that said first and second portions are separated by a bending line such that the angle between the first and second portions can be changed and in that the first portion is formed as an extension of the sidewall portion of the container and having a single position and in that the second portion has two positions, a first position where the second portion is arranged essentially parallel with the first portion and extending in a direction from the bending line and away from the container bottom and a second position where the second portion is bent downwardly about the bending line so that the second portion is arranged essentially parallel with the first portion, but where the second portion extends from the bending line down towards the container bottom of the container, wherein the central portion of the lid comprises a raised portion which is a highest portion of the rim portion of the lid, and wherein the raised portion of the lid and the rim portion of the lid form an upwards facing U shape groove such that when a vertical force is applied to the raised portion of the lid, then the central portion of the lid is displaced downwardly and the second locking element of the lid is pressed outwardly against the second locking element of the rim portion of the container and/or against the side wall portion of the container, wherein the second portion of the rim portion of the container is configured to remain in the second position when the lid is removed from the container.

11. The packaging according to claim 10, wherein the rim portion of the container comprises a third annular locking element and in that the rim portion of the lid comprises a third annular locking element which engages with the third annular locking element of the rim portion of the lid when the lid is mounted on the container.

12. The packaging according to claim 11, wherein the third annular locking element on the rim portion of the container is arranged on an inner surface of the container.

13. The packaging according to claim 12, wherein the third annular locking element on the rim portion of the container is arranged above the second annular locking element.

14. The packaging according to claim 10, wherein the lid further comprises a lid lever which has a first position where it is extending downwardly along the side of the container and a second position where the lid lever is bent outwardly about a bending line until an outer portion of the lid lever engages with an outer portion of the rim portion of the container.

* * * * *